US006102485A

United States Patent [19]

Parrott

[11] Patent Number: 6,102,485

[45] Date of Patent: Aug. 15, 2000

[54] WATER SEAL ARRANGEMENT

[75] Inventor: George Albert Parrott, Barnsley, United Kingdom

[73] Assignees: Minnovation Limited, United Kingdom; Kennametal, Inc., Latrobe, Pa.

[21] Appl. No.: 09/261,782

[22] Filed: Mar. 3, 1999

[30] Foreign Application Priority Data

Mar. 6, 1998 [GB] United Kingdom ..... 9804631

[51] Int. Cl.[7] ..... E21C 35/187

[52] U.S. Cl. ..... 299/81.3; 299/81.1; 299/81.2; 285/94; 277/408

[58] Field of Search ..... 299/81.1, 81.2, 299/81.3; 285/94; 277/408, 918, 589, 563

[56] References Cited

U.S. PATENT DOCUMENTS

| | | | |
|---|---|---|---|
| 3,698,769 | 10/1972 | Amoroso | 299/81.3 |
| 3,876,254 | 4/1975 | Parker . | |
| 4,289,357 | 9/1981 | Hintermann et al. | 299/81.2 |
| 4,449,738 | 5/1984 | Hotger . | |
| 4,565,410 | 1/1986 | Hotger | 299/81.2 |
| 4,836,613 | 6/1989 | Adam | 299/81.2 |
| 4,921,306 | 5/1990 | Tomlin | 299/17 |
| 5,087,082 | 2/1992 | Anthonsen | 285/94 |
| 5,098,166 | 3/1992 | Ebner et al. | 299/81.2 |
| 5,114,213 | 5/1992 | Kornecki et al. | 299/81.2 |
| 5,507,565 | 4/1996 | LeBegue et al. | 299/81.2 X |
| 5,690,392 | 11/1997 | Clapham | 299/81.1 X |

FOREIGN PATENT DOCUMENTS 2205880 12/1988 United Kingdom .

*Primary Examiner*—Eileen Dunn Lillis
*Assistant Examiner*—Sunil Singh
*Attorney, Agent, or Firm*—Trexler, Bushnell, Giangiorgi & Blackstone, Ltd.

[57] ABSTRACT

A water seal arrangement for use at a water transfer zone between a static member (2) and an associated rotary member (16) comprises a water delivery network (13) in the static member (2) including a water delivery port in fluid flow communication with a water receiving port of a water distribution network (12) in the rotary member (16), pairs of spaced-apart, circumferential seals (20) carried by the static or the rotary member (2 or 16), with each pair located to opposite sides of the ports (14), and in sealing engagement with a peripheral portion (22) of the rotary or static member (16 or 2); an oil supply network (27) to a zone (25) between each pair of seals (20), and an intensifier (30) to pressurize the oil of the oil supply network (27) to a higher pressure than the water pressure. Also, the water seal arrangement above includes a machine.

13 Claims, 3 Drawing Sheets

WATER SEAL ARRANGEMENT

FIELD OF THE INVENTION

This invention relates to a water seal arrangement for sealing a water supply during conveyance of water from a static member to an associated rotary member. Such a fixed member could be a support arm for a rotary member in the form of mineral cutter drum or head, where a supply of pressurised water is required for discharge at spray nozzles provided on the drum for various purposes such as dust suppression, pre-start warning and, if coal mining is involved, incendive sparking suppression.

1. Background of the Invention

However, with so-called continuous mining machines, in contrast to shearer type mining machines, the difficulties involved not only in introducing water to the cutting heads but also fear that the inevitable leakage will cause serious damage to bearings etc., has resulted in the use of "dry" machines, because firstly relatively large diameter lip-type seals, or ceramic/carbon mechanical seals, with consequent relatively high peripheral speeds are unavoidable, and secondly because there will at some stage be a lack of water at the seals for any one of a variety of operational reasons, resulting in the seals running dry and thus having an unacceptably short service life.

2. Object of the Invention

A basic object of the present invention is the provision of a relatively long life and effective water seal arrangement between a static and a rotary member at a water transfer zone between those members.

SUMMARY OF THE INVENTION

According to a first aspect of the invention there is provided a water seal arrangement for use at a water transfer zone between a static member and an associated rotary member comprising:

(i) a water delivery network in the static member including a water delivery port in fluid flow communication with (ii) a water receiving port of a water distribution network in the rotary member, (iii) multiple pairs of spaced-apart, circumferential seals carried by the static or rotary member, with each pair located to opposite sides of the ports, and in sealing engagement with a peripheral portion of the rotary or static member;

(iv) an oil supply network to a zone between each pair of seals, and (v) means to pressurise the oil of the oil supply network to a higher pressure than the water pressure.

Thus, the introduction of oil, between each pair of seals, at an oil pressure above the water pressure, not only ensures that the seals are constantly lubricated thereby ensuring long life but also, due to the ingress of oil behind the seals urges the seals into sealing engagement and ensures that the lower pressure water cannot pass the higher pressure oil or seal subjected to the oil pressure.

The oil pressure may be 10% to 15% above the water pressure.

Conventionally, on a mining machine of the so-called continuous miner type, the machine is self-propelled, being endless track mounted, and is provided with an on-board water pump driven from an on-board power source, to create the water pressure, and although the pressurised water supply and oil supply could be totally separated, which would involve a requirement for means to create the higher pressure in the oil, preferably they are interrelated such that water pressure is used to create the higher oil pressure eg via an intensifier. Thus, when water pressure is turned on, the oil pressure is automatically created. Furthermore, the arrangement may be that when the water pressure is turned off, the oil pressure falls away, or alternatively is retained eg if a check valve is provided in the oil supply network or circuit.

The water delivery network of the static member preferably includes a plurality of radial delivery ports open to the periphery of the rotary member, and the water distribution network of the latter preferably includes a circumferential groove aligned with the radial delivery ports, from which groove extend a plurality of radial distribution ports leading to axial distribution ports and thence to spray nozzles of the cutting head.

In an embodiment with an intensifier, the latter may take the form of a linear, piston and cylinder intensifier, with the water pressure applied to the full bore side of the piston and consequently with the annulus side operable on the oil and subjected to a coil compression spring. Oil supply to the annulus side may be from an oil reservoir via a check valve, with a connection to the seals between the check valve and the intensifier.

According to a second aspect of the invention there is provided a machine such as a mineral mining machine or a road planning machine provided with at least one water seal arrangement in accordance with the first aspect.

One embodiment of the invention is shown by way of example in the accompanying drawings, in which

DETAILED DESCRIPTION

Figure 1:
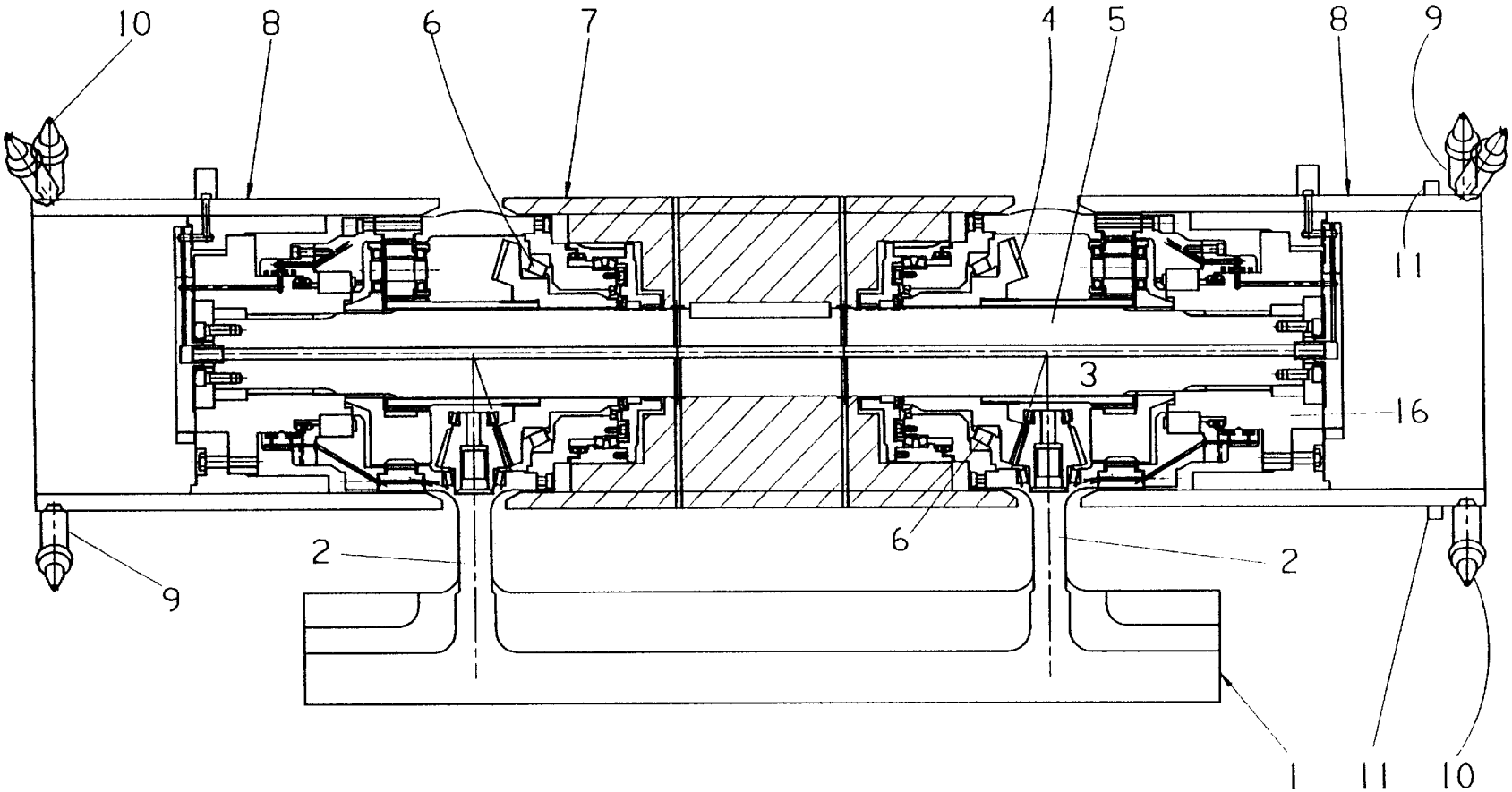
FIG. 1 is a part-sectional plan view of a portion of a continuous mining machine.
Figure 2:
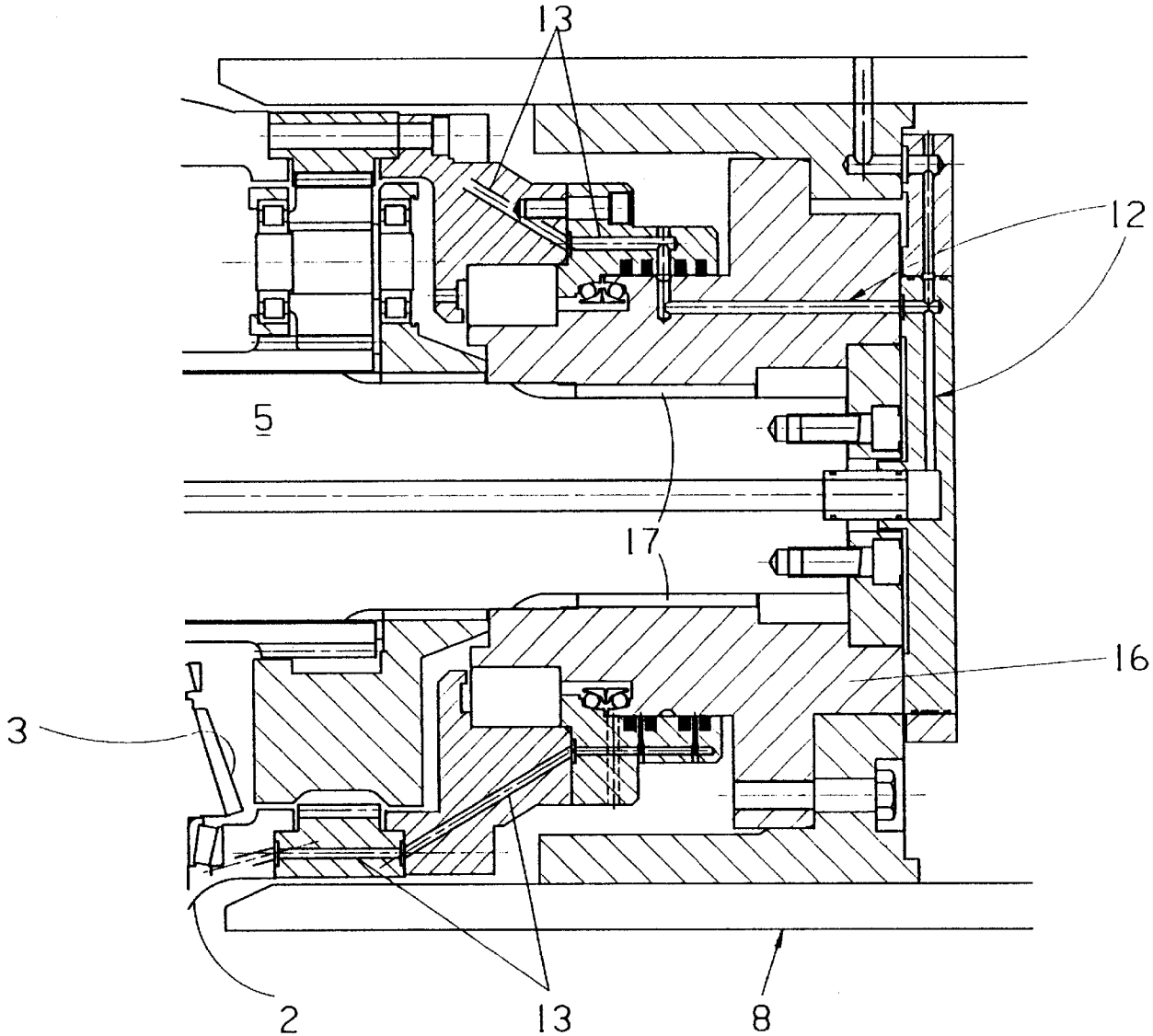
FIG. 2 is an enlarged sectional view of a portion of the right-hand side of FIG. 1.

In the drawings, a continuous mining machine 1 is provided with a pair of support arms 2 housing drive shafts each terminating in a bevel gear 3 in mesh with a bevel gear 4 of a transverse shaft 5 which rotatably carries via bearings 6, a central drum 7 and two end drums 8, to the external periphery of each of which is welded an array of pick boxes 9, each to receive a replaceable pick 10. In the vicinity of each pick 10 is a water spray nozzle 11 forming part of a water distribution network 12 in the drum, which receives water from a water delivery network 13 in the arms 2 and other static parts. The machine 1 is provided with an on-board water pump (not shown) to deliver pressurised water to the delivery network 13. The latter includes a plurality of radial delivery ports 14 aligned with a circumferential groove 15 in drum support 16 drivably mounted via splines 17 to the transverse shaft 5 and forming part of the water receiving network, which also includes a plurality of radial ports 18 and axially extending bores 19.

Four circumferential grooves 20 are provided in a static portion of the arms 2 and located two to each opposite side of the ports 14 groove 15 and ports 18. Each groove 20 receives a seal in the form of a sealing ring 21 urged into sealing engagement with periphery 22 of the sleeve 16 by resilient 'O' rings 23. Between each sealing ring 21 the static portion is relieved at 24 to create a circumferential oil chamber 25 supplied by a plurality of radial bores 26 forming part of an oil supply network 27.

Figure 3:
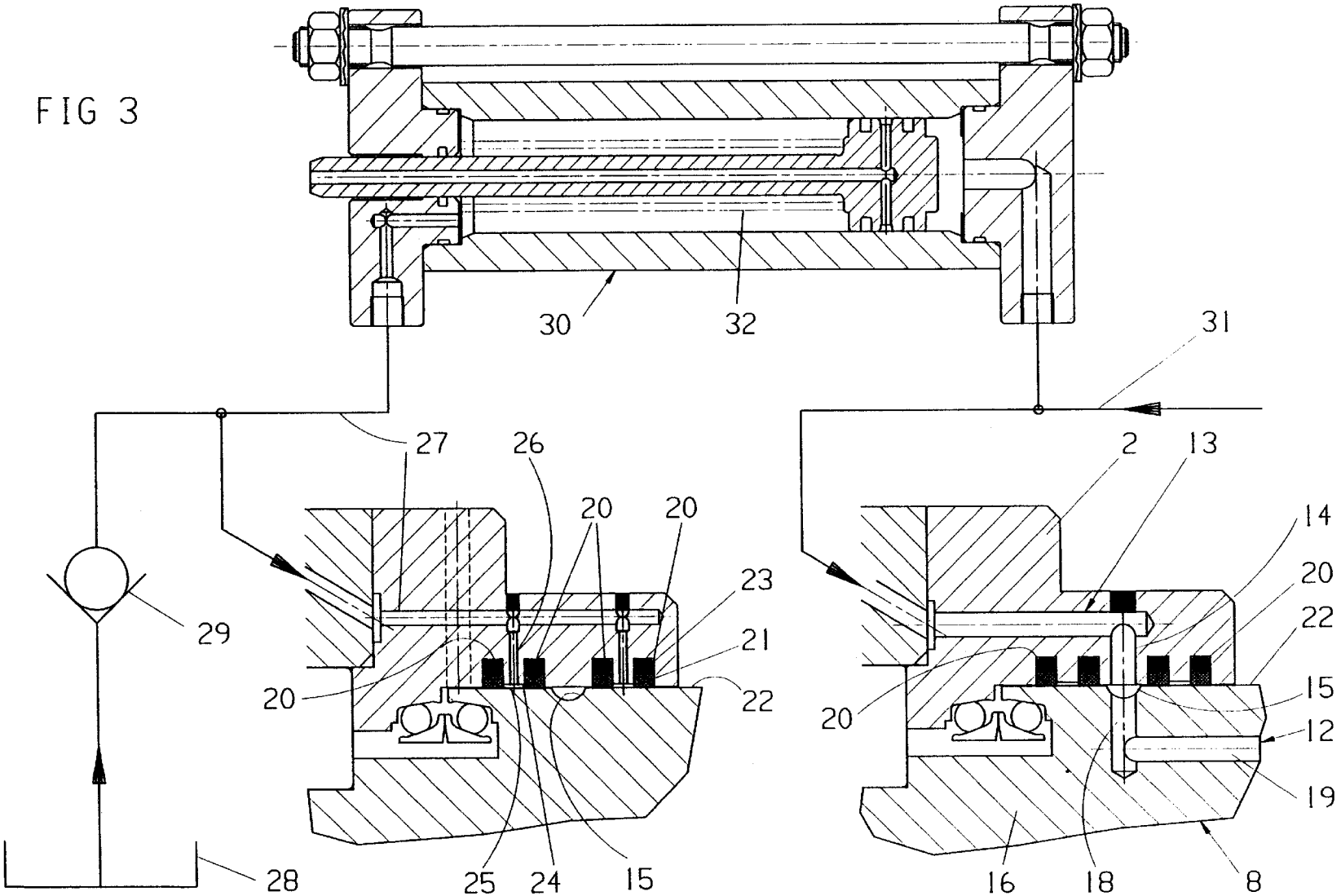
FIG. 3 is a further enlarged sectional and diagrammatic view of the water supply and oil supply.

As shown in FIG. 3, oil is supplied from a reservoir 28 via a check valve 29 to an intensifier 30 of the piston and cylinder type, with oil subjected to the annulus side, and water pressure, via line 31 connected to the on-board water pump, subjected to the full bore side. A coil compression spring 32 is effective on the annulus side. Consequently, when pressurised water is available at the full bore side, this displaces the piston to pressurise the oil network 27 to a level greater eg by 10% to 15%, than the water pressure. Consequently higher pressure oil is delivered to chamber 25 thereby lubricating the sealing rings 21 and also urging them into effective sealing engagement with the periphery 22 of the drum support 16.

What I claim is:

1. A water seal arrangement for use at a water transfer zone between a static member and an associated rotary member comprising:

(i) a pressurised water delivery network in said static member including a water delivery port in fluid flow communication with (ii) a pressurised water receiving port of a water distribution network in said rotary member, (iii) multiple pairs of spaced-apart, circumferential seals carried by said static or said rotary member, with each pair located to opposite sides of said ports, and in sealing engagement with a peripheral portion of said rotary or said static member;

(iv) an oil supply network to a zone between each pair of said seals, and (v) means to pressurise said oil of said oil supply network to a higher pressure than that of said pressurized water.

2. A water seal arrangement as claimed in claim 1, wherein said oil is pressurized from 10% to 15% above the water pressure.

3. A water seal arrangement as claimed in claim 1, wherein said water delivery network of said static member includes a plurality of radial delivery ports open to the periphery of said rotary member.

4. A water seal arrangement as claimed in claim 1, wherein said water distribution network of said rotary member includes a circumferential groove aligned with said radial delivery port of said static member.

5. A machine comprising a water seal arrangement for use at a water transfer zone between a static member and an associated rotary member comprising:

(i) a pressurised water delivery network in said static member including a water delivery port in fluid flow communication with (ii) a pressurised water receiving port of a water distribution network in said rotary member, (iii) multiple pairs of spaced-apart, circumferential seals carried by said static or said rotary member, with each pair located to opposite sides of said ports, and in sealing engagement with a peripheral portion of said rotary or said static member;

(iv) an oil supply network to a zone between each pair of said seals, and (v) means to pressurise said oil of said oil supply network to a higher pressure than that of said pressurized water.

6. A machine as claimed in claim 5, provided with an on-board water pump driven from an on-board power source, to create said pressurized water, and means is also provided to create said higher oil pressure.

7. A machine as claimed in claim 6, wherein said means to create said higher oil pressure is an intensifier using said pressurized water to create said higher oil pressure.

8. A machine as claimed in claim 7, wherein said intensifier takes the form of a linear, piston and cylinder intensifier, with said pressurized water applied to the full bore side of said piston and consequently with the annulus side operable on said oil and subjected to a coil compression spring.

9. A machine as claimed in claim 8, wherein oil supply to said annulus side is from an oil reservoir via a check valve, with a connection to said seals between said check valve and said intensifier.

10. A machine as claimed in claim 6, wherein, when said water pump is turned off, said oil pressure is retained.

11. A machine as claimed in claim 10, wherein said oil pressure is retained by a check valve.

12. A mining machine comprising a water seal arrangement for use at a water transfer zone between a static member and an associated rotary member comprising:

(i) a pressurised water delivery network in said static member including a water delivery port in fluid flow communication with (ii) a pressurised water receiving port of a water distribution network in said rotary member, (iii) multiple pairs of spaced-apart, circumferential seals carried by said static or said rotary member, with each pair located to opposite sides of said ports, and in sealing engagement with a peripheral portion of said rotary or said static member;

(iv) an oil supply network to a zone between each pair of said seals, and (v) means to pressurise said oil of said oil supply network to a higher pressure than that of said pressurized water.

13. A mining machine as defined in claim 12, wherein the mining machine is a continuous mining machine.

* * * * *